United States Patent [19]

Beeuwkes, III et al.

[11] Patent Number: 4,909,502

[45] Date of Patent: Mar. 20, 1990

[54] PASSIVE JAW EXERCISER

[75] Inventors: Reinier Beeuwkes, III, Ardmore, Pa.; Joseph B. Stella, Amherst, N.H.; Thomas E. Salisbury, Wayland, Mass.

[73] Assignee: Innovex, Inc., Media, Pa.

[21] Appl. No.: 276,695

[22] Filed: Nov. 28, 1988

[51] Int. Cl.[4] ..... A63B 23/00

[52] U.S. Cl. ..... 272/95

[58] Field of Search ..... 272/94, 95, 125, 126, 272/135, 143; 128/12, 17, 20, 777; 433/69

[56] References Cited

U.S. PATENT DOCUMENTS

| | | | |
|---|---|---|---|
| 742,698 | 10/1903 | Mason | 128/17 |
| 3,721,439 | 3/1973 | Rudolph et al. | 272/95 |
| 3,985,125 | 10/1976 | Rose | 128/17 |
| 4,292,026 | 9/1981 | Yokota | 433/69 |

FOREIGN PATENT DOCUMENTS

| | | | |
|---|---|---|---|
| 571057 | 2/1933 | Fed. Rep. of Germany | 128/12 |

*Primary Examiner*—Robert W. Bahr

*Attorney, Agent, or Firm*—James L. Jackson & Assoc.

[57] ABSTRACT

A passive jaw exerciser is provided for application of an anatomically applied jaw moving force for pivoting of the jaw at its tempero-mandibular joint or to provide a motion to the jaw which is beneficial in facial orthopedics. A body structure is provided having guide tracks which guide movement of a carriage according to the character of movement that is desired. The carriage is movable by a lever operated push rod to thereby cause corresponding movement of a mandibular jaw piece supported by a carriage relative to a maxillary jaw piece supported by the exerciser body. The position of engagement between the lever and the push rod is adjustable through selection of any one of a number of spaced slots that are formed in parallel webs of the lever structure.

17 Claims, 3 Drawing Sheets

PASSIVE JAW EXERCISER

FIELD OF THE INVENTION

This invention relates generally to jaw exercising devices for use in exercising the jaws of patients who have fractured the jaw bone and/or have undergone maxillo-mandibular surgery, wherein, to promote efficient healing, the mandibular arch is wired to the maxillary arch, thus immobilizing the jaw during the healing process. More particularly, this invention is directed to a passive jaw exerciser mechanism including maxillary and mandibular jaw pieces that are inserted into fully seated relationship with the teeth of the respective maxillary and mandibular arches and provides for controlled movement of the jaw pieces such that jaw opening movement occurs in natural anatomical manner about the tempero-mandibular joint of the patient.

BACKGROUND OF THE INVENTION

Exercise of jaw muscles is an important part of treatment and rehabilitation for many jaw injuries and disorders. For example, the common practice of wiring jaws closed as a splinting approach to fractures and bone surgical procedures leads to a shortening of the muscles that close the jaw and a weakening of the muscles that open it. As a result, patients may find it impossible to open their mouths after the wiring has been removed. Physicians and surgeons resort to expedients which include prying with tongue depressors and the use of screw operated wedge devices to stretch the muscles and thereby accomplish opening of the mouth. Once the jaws are opened, it is necessary for patients to undertake exercises to stretch the muscles in order to regain full freedom of motion. Passive elastic devices have been suggested for accompmlishing jaw exercising. Also, expensive spring operated instruments have been developed for this purpose.

A typical defect of most commercially available jaw exercising devices is that they either cause pain and injury through the exertion of excessive force or they may apply pressure to the molar region in a vertical manner thus displacing the condyles downward and disrupting the tempero-mandibular joint. None of these devices moves the lower jaw in a fashion which takes into account the structural features of the jaw hinge, namely that the pivotal point of the jaw hinge is above and to the rear of the mouth opening by virtue of the curvature of the jaw at its upper rear portion.

It is a principal feature, therefore, to provide a novel jaw exercising mechanism which accomplishes movement of the jaw by applying pressure to the teeth along the natural anatomical lines taking account of the natural angles of motion of the mandible.

It is also a feature of this invention to provide a novel passive jaw exercising device that avoids injury by allowing the patient to continuously meter the force that is applied to accomplish opening movement of the jaw.

It is an even further feature of this invention to provide a novel passive jaw exercising device that adjusts for both jaw size and for range of motion and provides for graded application of force for both opening and closing motions.

It is another feature of this invention to provide a novel passive jaw exercising mechanism that utilizes a hand grip designed to take advantage of the natural strength and endurance of the patient's first and second fingers and the patient's hand in general to provide both opening force and closing resistance to the jaw and thereby accomplishes exercising of the muscles that open and close the jaw.

It is a further feature of this invention to provide a novel passive jaw exercising mechanism that can be made inexpensively as a plastic molding for use by a single patient thus insuring against cross contamination between patients and providing for infection control.

It is also a feature of this invention to provide a novel passive jaw exerciser that is adaptable for use by a wide range of patient's having different size jaws through the use of different sized jaw pieces and/or jaw piece extensions.

It is an even further feature of this invention to provide a novel passive jaw exerciser that is capable of providing a motion that is beneficial in facial orthopedics through employment of a motion controlling track of a particular configuration.

SUMMARY OF THE INVENTION

A passive jaw exercising mechanism constructed in connection with the present invention includes a body structure having a handle extending therefrom. At the free end of the handle is pivotally attached a jaw moving lever to which manual force is applied by the hand of the patient using the device. The passive jaw exerciser includes maxillary and mandibular jaw pieces with the maxillary jaw piece being removably attached in immovable relation to the body during use. The mandibular jaw piece is removably supported by a carriage that is disposed in movable relation with the body. The body defines an arcuate track which receives a guide rail of the carriage and thus guides the carriage along the curved track during its movement. A push rod is pivotally connected at one end to the carriage and is adapted at the opposite end to establish connection with any one of several positioning notches or other connector devices that allow the patients to select the particular mechanical advantage and range of motion that is desired for jaw movement activity. In one form of the invention the positioning notches lie along the arc of a circle having its center at the pivot connecting the push rod to the carriage, thus having radius equal to the length of the push rod. Manual force applied to the push rod causes the carriage to move within the track and the curved shape of the track causes the mandibular jaw piece to tilt or establish an inclined relation with the maxillary jaw piece as it moves downward. Thus, although the tooth engaging surfaces of the jaw pieces are parallel in the starting position, the tooth engaging surfaces become angularly oriented as well as moved apart as the mandibular jaw piece moves toward its open position. The angular relation or tilt is such that the incisors are opened more widely than the molars, mimicking the natural motion of the jaw and thus causing the jaw to pivot about its tempero-mandibular joint. If a different jaw movement is desired for particular facial orthopedics, the configuration of the curved guide track will be established to effect such jaw movement.

In use the apparatus will be positioned such that the maxillary and mandibular jaw pieces are inserted between the teeth of the maxillary and mandibular arches of the patient with the maxillary jaw piece in full contact with the teeth of the maxillary arch for proper alignment of the exerciser device and with the teeth of the mandibular arch fully engaging the mandibular jaw piece. The patient will then grasp the handle of the device with the patient's fingers in contact with the operating lever. By applying force to the lever, causing it to pivot relative to the handle the force applied by the patient is transmitted through the push rod to the mandibular jaw piece, causing it to move within the curved track. The patient is capable of controlling movement of the mandibular jaw piece to the extent appropriate for jaw exercising activities. In the opposite direction, the patient can then close the jaw through use of the jaw muscles while manually applying force as resistance to jaw closing movement. Thus, the muscles of the jaw are capable of being exercised during both opening and closing movement while the jaw is controllably moved about its tempero-mandibular joint.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

IN THE DRAWINGS

Figure 1:
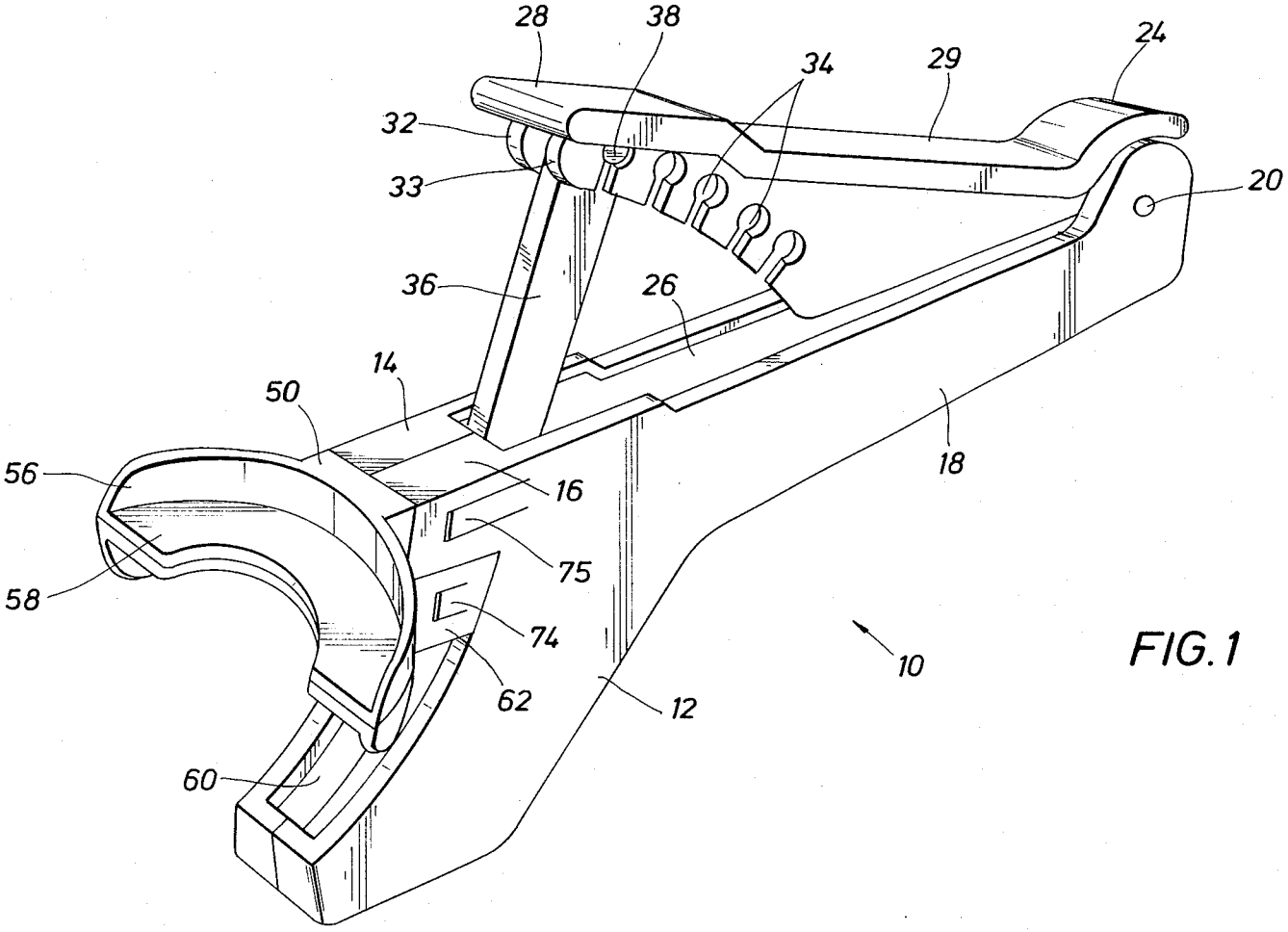

FIG. 1 is an isometric illustration of a passive jaw exerciser mechaniam constructed in accordance with the present invention and showing the jaw pieces thereof in the position for maximum closure of the jaw.

Figure 2:
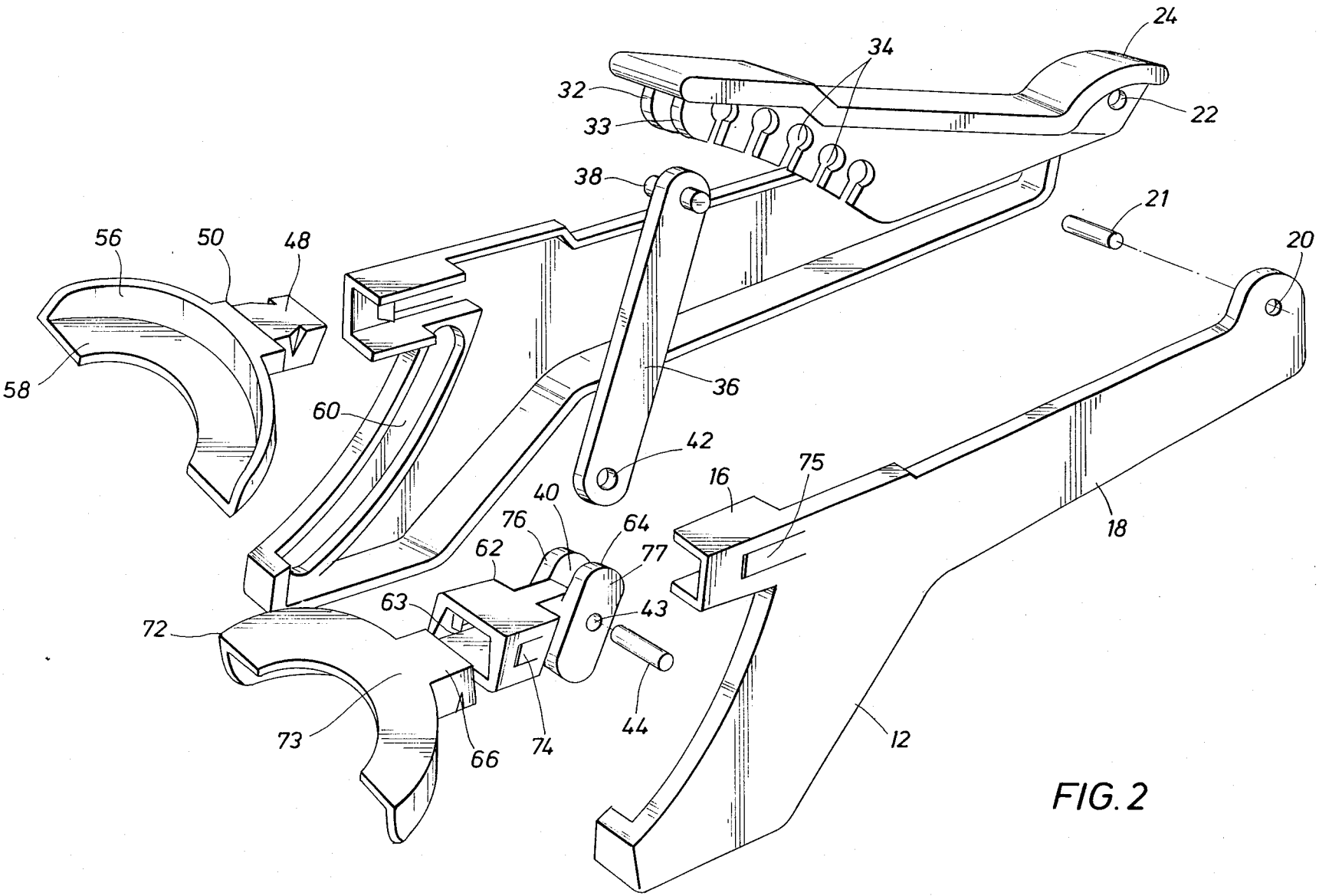

FIG. 2 is an exploded isometric view of the passive jaw exerciser apparatus of FIG. 1, illustrating the various component parts thereof.

Figure 3:
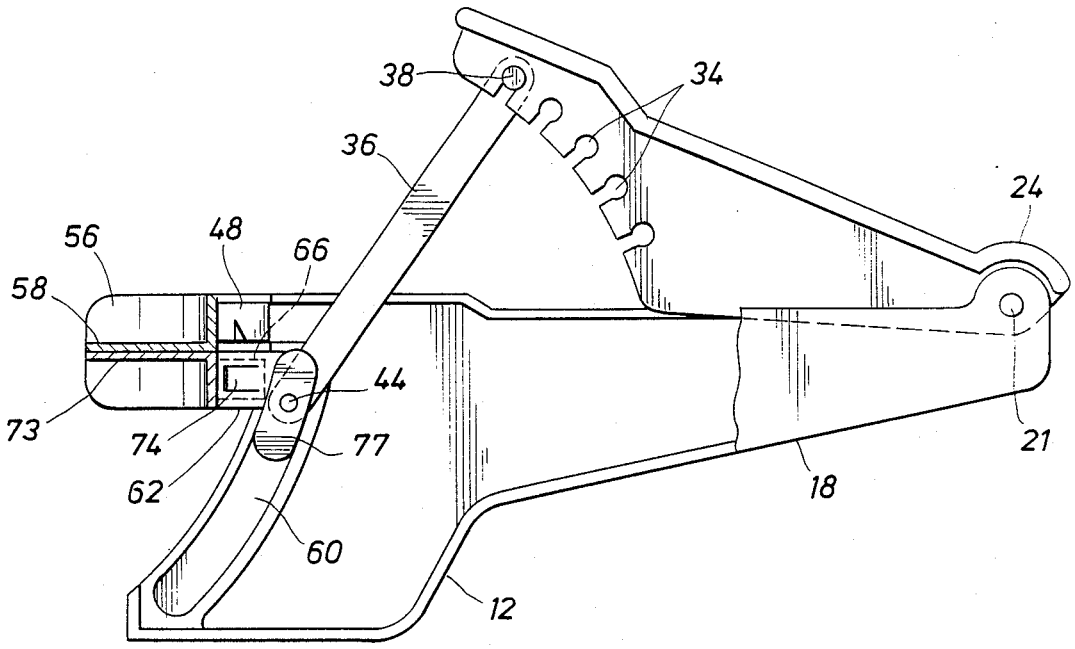

FIG. 3 is an sectional illustration of the apparatus of FIGS. 1 and 2 showing the jaw pieces in the closed position thereof.

Figure 4:
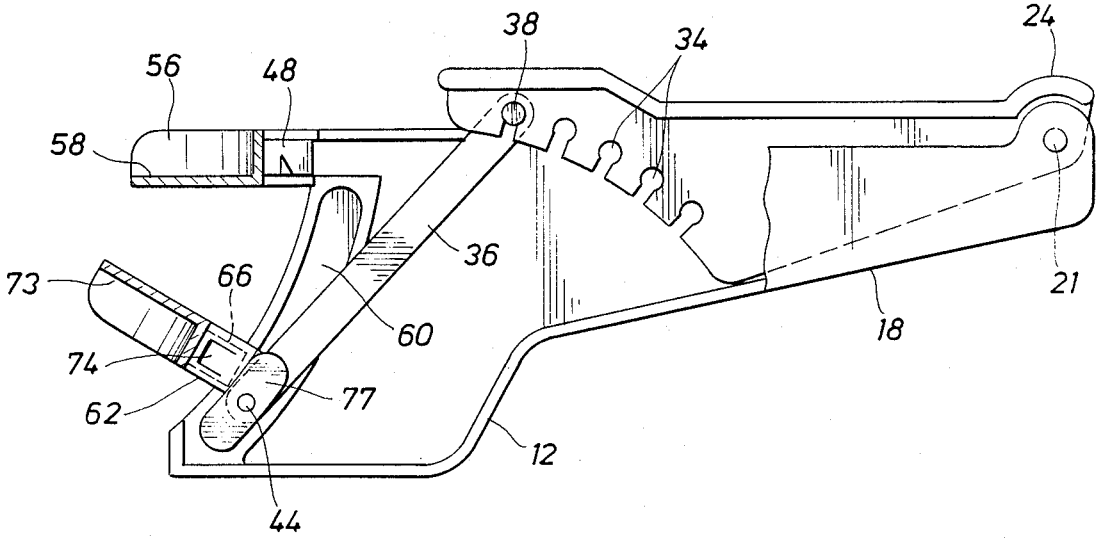

FIG. 4 is a sectional view of the passive jaw exerciser device of FIGS. 1 and 2 with the jaw pieces thereof shown in the open position.

DETAILED DESCRIPTION OF PREFERRED EMBODIMENT

Referring now to the drawings and first to FIG. 1, a passive jaw exerciser mechanism constructed in accordance with the present invention is shown generally at 10 by way of isometric illustration. The apparatus incorporates a body structure 12 that is formed by substantially mirror image body halves 14 and 16. The body structure 12 incorporates a handle 18 also defined by the body halves which forms a pivot aperture 20 that receives a pivot pin 21 which also engages within a pivot aperture 22 defined at one end of a pivotal lever 24. The lever 24 extends through an elongate rectangular opening 26 defined by the handle portions of the body halves and forms a curved upper flange portion 28 that forms a grip section 29 that is engaged by the fingers of the user's hand to facilitate manual manipulation of the lever to accomplish jaw opening movement and to permit application of manual resistance force to resist jaw closing movement. The lever 24 is urged toward its upstanding position as shown in FIG. 1 by means of a spring element, not shown, which may conveniently take the form of a torsion spring, leaf spring or any other suitable spring member. The lever 24 defines a pair of web members 32 and 33 extending transversely to the upper finger engaging flange portion 28 thereof. The web members each define a plurality of positioning slots 34 spaced along the length of the curved inner surface portions thereof. The positioning slots 34 are arranged in an arc of a circle having its center at a pivot connecting a push rod to a jaw moving carriage as will be discussed herein below. A push rod member 36 defines an upper transverse projection 38 adapted to be received within portions 32 and 33 of the handle to establish the jaw piece movement and mechanical advantage that is desired by the patient. The lower end of the push rod 36 is received within a slot 40 formed by a carriage member and forms an aperture 42 which is disposed in registry with pivot apertures 43 and pivotally secured to the carriage by means of a pivot pin 44. This enables the lower end of the push rod to be pivotally connected to the jaw moving carriage member as will be explained in detail hereinbelow.

At the forward end of the body structure 12 the body halves 14 and 16 cooperate to define an opening 46 of trapezoidal configuration that is adapted to receive the connecting projection 48 of a maxillary jaw piece 50 in close fitting relation therein. The connecting projection 48 is also of trapezoidal configuration corresponding to the configuration of the opening 46. The connecting projection 48 forms a pair of opposed locking notches 52 that are engaged by latch members 54, formed by the respective body halves, when the maxillary jaw piece 50 is inserted into the trapezoidal receptacle or opening 46 and locked in position in the manner shown in FIG. 1. The maxillary jaw piece is substantially immovable relative to the body structure 12. The purpose of the trapezoidal configuration of the receptacle 46 and the connecting projection 48 is to ensure proper orientation of the jaw pieces upon their assembly to the body structure and carriage. It should be appreciated that connecting structures of other design may be employed in like manner to ensure proper orientation of the jaw pieces. Maxillary jaw piece 50 forms a curved upstanding wall 56 that conforms substantially to the arch form of the patients anterior teeth and also forms a substantially flat plate 58 which may be integral with the upstanding wall portion 56 and other structural portions of the maxillary jaw piece and which is of curved configuration. The plate 58 is adapted to be engaged by portions of the occlusal and incisal surfaces of the patient's teeth to thus allow the maxillary jaw piece to be aligned with respect to the bite plane of the teeth. It is this alignment that insures movement of the patient's jaw about the temporal-mandibular joint.

In one form of the invention the body halves further define opposed internal tracks 60 in the form of curved slots having a curvature that, with the maxillary jaw piece aligned with respect to the bite plane of the patient, a "virtual" hinge point is established that is close to the patient's temporal-mandibular joint. In another form of the invention the location and curvature of the tracks 60 may be altered such as to provide a motion which is beneficial in facial orthopedics.

As shown in FIG. 2 of the drawings, the passive jaw exerciser includes a carriage member 62 forming a rearwardly extending bifurcated projection 64 that forms the slot 40 into which the push rod 36 is received. The projection 64 also defines an apertures 43 that receive pivot pin or bolt 68 that also extends through the aligned apertures to maintain the push rod and the projection 64 in pivotal assembly. The slot 40 receiving the lower end of the push rod, is aligned with respect to the center of the webs 32 and 33 of the lever 24, thus permitting centralized force transmission from the lever, through the push rod to the central portion of the carriage.

At its forward extremity the carriage 62 defines a receptacle 63 of generally trapezoidal configuration which receives the connecting projection of a mandibular jaw piece 72. The carriage also defines opposed latch elements 74 that engage within appropriate locking slots 75 formed in the connector extension 66 of the jaw piece to latch the jaw piece into positively assembled relation with the carriage. The jaw piece 72 may be of identical construction as compared with the construction of the maxillary jaw piece 50 but merely inverted for registry with the teeth of the patient's mandibular arch. The jaw members and the body and carriage also form flat mating surfaces such as shown at 73 that allow the flat plates of the jaw members to be positioned in juxtaposed relation as shown in FIG. 1. This enables the flat plates of the jaw members to be inserted between the maxillary and mandibular teeth of the patient even when minimal jaw movement is allowed. The use of connector receptacles of trapezoidal configuration in both the body structure and carriage of the passive jaw exerciser insures that the maxillary and mandibular jaw pieces can only be assembled to the body and carriage in the positions shown in FIG. 1. Obviously, the connecting receptacles may be of any other suitable configuration that insures that the maxillary and mandibular jaw pieces can be assembled to the body and carriage only in the proper positions.

To establish a properly guided relation of the carriage relative to the body structure the carriage member 62 is provided with a pair of curved opposed guide rails 76 and 77 which are received in guided relation within the curved slot or guide track 60 of the body structure. Thus, as force is applied through the handle and push rod to the carriage 62, the carriage is restricted in its movement to the length and curvature of the track 60. Force applied to the push rod causes the carriage to move within the guide track and the shape of the track causes the mandibular jaw piece to tilt as it moves downwardly. Thus, although the flat occlusal surfaces of the jaw pieces are disposed in intimate parallel relation at the starting position of the apparatus with the lever 24 in the position shown in FIG. 1, the flat curved occlusal plates 58 of the jaw pieces will maintain engagement with the teeth during movement and will become inclined to one another as well as moved apart as the jaw is moved toward its fully open position. The tilt or incline of the jaw pieces is such that the incisors are opened more widely than the molars, thereby mimicking the natural motion of the jaw as it pivots about the tempero-mandibular joint.

In order to accommodate patient's jaws of different sizes, interchangeable jaw pieces can be provided in small, medium and large dimensions. Further, the jaw pieces are designed to receive a resilient impression compound in order to equalize the force distribution on teeth and gums in edentulous and partially edentulous patients. The jaw pieces may be provided with connector extensions of varying length in order to achieve the character of movement that is desired for the patient.

The opposed parallel webs 32 and 33 of the lever 24 is provided with a series of positioning slots 34 within which the transverse pin 38 of the push rod is received in releasable engagement. These spaced notches are located along the arc of a circle having its center at the pivot point of the carriage 62 which is formed by apertures 43. Thus, the starting height of the lever is the same regardless of which set of notches is engaged by the pin 38 of the push rod. The shape of the notches defines an outer restriction through which the pin 38 must be forced to establish full engagement of the pin within the respective notches. This notch shape and the relationship of the notches with the transverse pin 38 of the push rod allows the push rod to snap into assembly with a respective notch and be detained within the opening; but to allow simple relocation of the push rod by the patient or physician. Numbering of the notches, such as from 1 to 6 for example, can provide a scale of force of thus allow the patient or physician to select the force that is appropriate for the therapy that is desired for the patient.

The carriage and handle are preferably molded from materials which slide easily on one another. For example, the carriage may be composed of acetal while the body structure and other components of the jaw exerciser may be composed of nylon or any other suitable material. This insures smooth transmission of force from the lever to the mandible. The materials may be chosen to permit autoclaving or other types of sterilization. The latch devices for the jaw pieces may be designed either to allow or prevent removal of jaw pieces once inserted.

The patient would be expected to use this passive jaw exerciser device several times a day for a period up to six months after removal of jaw wiring. The patient would begin using the lever in a position of greatest mechanical advantage, as position 5, which causes small relative motion to the jaw pieces while allowing greater force to be exerted to the jaw pieces through the lever and push rod. Successive adjustments would be made as the jaw mobility of the patient progresses, ending in the position of the push rod 36 and its transverse projection as shown in FIG. 1 which shall be referred to herein as position 1, assuming that the patient's jaw have a full range of motion. For exercise in closing the jaw, the patient may begin in with the exerciser device 10 in the position 1 configuration as shown in FIG. 1, opening the jaw with gentle pressure on the lever and closing it against manual force applied through the lever and push rod. The device may be provided in connection with a chart or work sheet in which the patient may use as a guide to exercising and as a progress sheet.

By interlocking the upper part of the push rod 36 with selected ones of the different positioning notches 34 of the lever, both the range of motion and the mechanical advantage of the apparatus may be adjusted. By using a notch close to the pivot point of the lever as a high mechanical advantage appropriate to the large forces required to move a nearly closed jaw is obtained. By using a notch near the tip of the lever a large range of motion about 1½ inches is obtained with no mechanical advantage. This is ideal for both opening and closing exercises in the latter stages of jaw rehabilitation.

In use, the patient will hold the passive jaw exerciser by the handle 18. The thumb passes under the handle and the fingers will wrap around the movable lever 24 with the fingers engaging the smoothly curved upper surface 28 thereof. The patient will then insert the curved maxillary and mandibular jaw pieces 50 and 72 between the teeth, with the jaw pieces positioned in the closed relation shown in FIG. 1. This requires that a small degree of opening, about ¼ inch has already been achieved to allow the jaw pieces to be inserted. The patient, by clsoing the hand will then squeeze the lever 24 towards the handle and the push rod 36 will cause the mandibular jaw piece to move downwardly along the curved track. The curvature of the track causes a virtual hinge point close to the patient's tempero-mandibular joint. Thus, the mandibular jaw piece tilts as it moves downwardly, following the natural motion of the lower jaw. By interlocking the upper part of the push rod with different notches in the lever, both the range of motion and the mechanical advantage may be adjusted.

What is claimed is:

1. A passive jaw exerciser for application of anatomically applied jaw moving force for pivoting of the jaw of a patient comprising:

(a) an exerciser body forming a handle adapted to be grasped by a user and forming a curved track;

(b) maxillary jaw means extending from said exerciser body and having a curved maxillary occlusal member adapted for contact with the teeth of the maxillary arch of the patient;

(c) mandibular jaw means being movably received by said exerciser body and having a curved mandibular occlusal member adapted for contact with the teeth of the mandibular arch of the patient, said mandibular jaw means defining guide rail means being received in guided relation within said curved track and establishing a range of arcuate motion of said mandibular jaw means relative to said exerciser body and being guided by said curved track, said curved track having a curvature substantially coincident with the arc of pivotal movement of the patient's jaw and causing said mandibular jaw means to induce pivotal jaw movement of the patient substantially about the tempero-mandibular joint of the patient; and (d) a lever being pivotally connected to said exerciser body and having driving connection with said mandibular jaw means, said lever being manually manipulated for inducing movement of said mandibular jaw means relative to said exerciser body and said maxillary jaw means.

2. A passive jaw exerciser as recited in claim 1 wherein said mandibular and maxillary jaw means define occlusal surfaces that are disposed in substantially parallel relation when said jaw means are closed and are movable to an inclined relation as said jaw means are moved apart.

3. A passive jaw exerciser as recited in claim 1 wherein:

(a) said guide rail means including a carriage member being in movable assembly with said exerciser body and defining guide rails that are disposed in guiding relation with said curved track; and (b) said carriage member providing support for said mandibular jaw means and being guided by said track means to induce movement of said mandibular jaw means from a parallel juxtaposed relation with said maxillary jaw means to a position where said mandibular jaw means is disposed in downwardly spaced and inclined relation with said maxillary jaw means.

4. A passive jaw exerciser as recited in claim 1 wherein said maxillary and mandibular jaw means are of substantially identical configuration and are each retained in assembly with said body structure with said maxillary jaw means being in fixed relation with said exerciser body and said mandibular jaw means being in movable relation with said exerciser body.

5. A passive jaw exerciser as recited in claim 1, wherein:

(a) said exerciser body defines a first receptacle;

(b) said maxillary jaw means includes a connector portion received in interfitting relation within said first receptacle;

(c) said guide rail means including a carriage member movably received by said exerciser body and establishing guiding relation with said curved track, said carriage member defining a second receptacle receiving a connector portion of said mandibular acclusal member in interengaging relation therein.

6. A passive jaw exerciser as recited in claim 5 wherein:

said first receptacle and said second receptacle form latch means establishing locking engagement respectively with said maxillary jaw means and said mandibular occlusal member.

7. A passive jaw exerciser as recited in claim 6, wherein:

said maxillary jaw means and said mandibular occlusal are of substantially identical configuration, each defining locking slots establishing locking engagement with respect to said latch means of said exerciser body and said carriage member.

8. A passive jaw exerciser as recited in claim 5 wherein:

(a) said first and second receptacles are of inverted orientation and are of a predetermined configuration;

(b) said maxillary jaw means and said mandibular occlusal member are of substantially identical configuration and each form a connector element of a configuration establishing respective mating relation with said first and second receptacles, thereby insuring proper orientation of said maxillary jaw means and said mandibular occlusal member upon respective assembly to said exerciser body and said carriage member.

9. A passive jaw exerciser as recited in claim 1 wherein said means for inducing movement of mandibular jaw means relative to said exerciser body further comprises:

a push rod extending from said mandibular jaw means and engaging said lever, whereby upon pivoting of said lever relative to said exerciser body said mandibular jaw means is moved away from said maxillary jaw means and is guided during such movement by said curved track.

10. A passive jaw exerciser as recited in claim 9, wherein:

said lever forms a plurality of spaced push rod connections each being selectively engaged by said push rod for controlling the mechanical advantage of said passive jaw exerciser and the range of motion of said mandibular jaw means.

11. A passive jaw exerciser as recited in claim 10, wherein:

(a) a carriage member is guided for movement by said curved track; and (b) said spaced push rod connections are defined by spaced slot means being positioned along the length of of said lever.

12. A passive jaw exerciser as recited in claim 9, wherein:

(a) a said guide rail means comprise carriage member being movably assembled to said exerciser body and being disposed in guided relation with said curved track during movement thereof; and (b) a said mandibular acclusal member being disposed in interlocking, releasable assembly with said carriage means and being movable along with said carriage member.

13. A passive jaw exerciser as recited in claim 1, wherein:

(a) said exerciser body is formed by body halves of substantially mirror image and said body halves define pivot means and form curved opposed slots defining said curved track, said body halves also cooperating to define a first receptacle;

(b) said mandibular jaw means forming a connector projection being received in interfitting relation within said first receptacle;

(c) said mandibular guide rail means comprising a carriage forming opposed guide rails being received in guiding relation within said opposed curved slots of said curved track, said carriage forming a second receptacle and said mandibular acclusal member forming a connector projection being receivable in interfitting relation within said second receptacle; and (d) said means for inducing movement of said mandibular jaw means further comprising a push rod establishing force transmitting interconnection with said lever and said carriage thus permitting movement of said carriage and said mandibular jaw piece upon pivoting of said lever.

14. A passive jaw exerciser for application of anatomical or facial orthopedic movement to the jaw of a patient, comprising:

(a) an exerciser body forming a handle adapted to be grasped by the hand of a user, said exerciser body forming a curved track and having first receptacle means;

(b) a maxillary jaw piece adapted to fit the maxillary dental arch of the patient and having a connector releasably engaging said first receptacle means;

(c) a carriage being supported for movement by said curved track of said exerciser body and forming second receptacle means;

(d) a mandibular jaw piece adapted to fit the mandibular dental arch of the patient and having a connector releasably engaging said second receptacle means;

(e) a push rod extending from said carriage; and (f) a lever being pivotally connected with said exerciser body and forming a plurality of spaced push rod connections each being selectively engaged by said push rod for controlling the range of motions and mechanical advantage of said carriage.

15. A passive jaw exerciser as recited in claim 14, wherein:

said plurality of spaced push rod connections are arranged in the arc of a circle having its center at the connection of said push rod with said carriage.

16. A passive jaw exerciser as recited in claim 15, wherein:

said connection of said push rod with said carriage is formed by a pivot.

17. A passive jaw exerciser as recited in claim 14, wherein:

said mandibular and maxillary jaw pieces each form occlusal surfaces disposed for engagement by the teeth of the patient, said occlusal surface of said mandibular jaw piece being movable from a parallel juxtaposed relation with said occlusal surface of said maxillary jaw piece to a spaced inclined relation with said occlusal surface of said maxillary jaw piece.

* * * * *